United States Patent [19]

De Haes et al.

[11] 4,033,770

[45] July 5, 1977

[54] PRODUCTION OF ADHESIVE TRANSFERS BY DIFFUSION TRANSFER

[75] Inventors: Louis Maria De Haes, Edegem; Leon Louis Vermeulen, Broechem; Hugo Karel Gevers, Edegem; Walter Frans De Winter, Gravenwezel, all of Belgium

[73] Assignee: AGFA-GEVAERT N.V., Mortsel, Belgium

[22] Filed: Apr. 4, 1975

[21] Appl. No.: 565,249

[30] Foreign Application Priority Data

Apr. 11, 1974 United Kingdom ..... 16212/74

[52] U.S. Cl. ..... 96/28; 96/3; 96/29 R; 96/29 D; 156/230; 156/234; 156/236; 428/914

[51] Int. Cl.[2] ..... G03C 11/12; G03C 5/54; G03C 7/00; B44C 3/00

[58] Field of Search ..... 96/29 R, 29 D, 28, 3; 427/277; 156/230, 234, 236; 428/914

[56] References Cited

UNITED STATES PATENTS

| | | | |
|---|---|---|---|
| 2,843,485 | 7/1958 | Yutzy et al. | 96/29 R |
| 3,131,106 | 4/1964 | Mackenzie | 156/230 |
| 3,520,682 | 7/1970 | Gross | 96/29 R |
| 3,614,839 | 10/1971 | Thomas | 96/29 D |
| 3,644,116 | 2/1972 | Andrews et al. | 96/29 R |
| 3,647,442 | 3/1972 | Malster | 96/29 D |
| 3,674,622 | 7/1972 | Plasse | 425/425 |
| 3,721,557 | 3/1973 | Inoue | 96/28 |

FOREIGN PATENTS OR APPLICATIONS

| | | |
|---|---|---|
| 728,607 | 2/1966 | Canada |

*Primary Examiner*—David Klein
*Assistant Examiner*—Richard L. Schilling
*Attorney, Agent, or Firm*—William J. Daniel

[57] ABSTRACT

Process and material for the production and use of pressure sensitive and for heat sensitive and/or solvent sensitive decalcomanias, formed according to the principles of the silver complex diffusion transfer process.

23 Claims, No Drawings

PRODUCTION OF ADHESIVE TRANSFERS BY DIFFUSION TRANSFER

The present invention relates to a method for producing transfer images known as decalcomania and to a material for producing such images.

Decalcomania is the art or process of transferring pictures and designs from specially prepared paper to a receptor material e.g. metal, glass, paper, china etc., and permanently fixing them thereto. It is also the picture or design prepared to be so transferred.

Transfer materials (decalcomanias) which comprise a carrier sheet, a plurality of ink indicia on said carrier sheet and an adhesive which is either present in the ink indicia or is applied over the indicia are known, e.g., from the United Kingdom Patents 906,934 filed Jan. 21, 1958 by Letraset Limited, 1,113,695 filed Oct. 30, 1964 by Letraset Limited, 1,124,082 filed Aug. 3, 1965 by Letraset Limited and 1,324,796 filed Oct. 22, 1970 by Letraset Limited. In the production of transfer images with said materials pressure is applied to the reverse face of the carrier sheet, while kept in contact with a receptor material, hereby obtaining the adherence of the adhesive to the receptor surface in such a degree that on separating the carrier sheet from the receptor surface an indicium or indicia remain on the receptor surface.

It is necessary that the bond created by the adhesive with the receptor surface is greater than the bond between an indicium and the carrier sheet. The adhesive can be one that is activated by the application of pressure water or a solvent, or by heat.

If it is desired to use a pressure-sensitive adhesive, the surface-tack of the adhesive has necessarily to be low if freedom to position the contacting materials is to be achieved.

A drawback of the methods and materials used in the prior art is the dependency on the supply of eleswhere produced indicia assortments, which cannot include all types of indicia wanted by the user who has a very restricted choice.

In the prior art normally the indicia are transferred one by one to a receptor surface. A lay-out composed of one by one transferred indicia can only be re-made after the same time-consuming operation is repeated. The lack of the possibility to dispose of a lay-out composed of multiple indicia that are transferable simultaneously constitutes a substantial drawback, e.g. in publicity work and consequently this fact has a refraining action on the extensive use of decalcomanias in that field.

Another drawback of some materials described in the prior art is the fact that adhesive indicia have to be produced according to known printing techniques. These techniques when operating for the production of decalcomanias may involve drawbacks such as the use of special inks, lack of detail, line and dot spreading, and a particularly long drying time of the inks. Moreover, the preparation of adhesivee indicia masters by printing asks for a relatively large machinery and expensive maintenance.

It is an object of the present invention to provide a new and improved method for the production of decalcomanias.

It is another object of the present invention to provide materials for producing decalcomanias in which the indicia are obtained through a photographic process.

According to the present invention transfer images are produced by a process comprising the steps of 1) photographically exposing a photographic material containing a light-sensitive silver halide emulsion layer, 2) contacting the emulsion layer side of the exposed photographic material with a supported image-receiving layer of an image-receiving material, in the presence of a liquid that makes the development of the exposed silver halide to take place and substances to diffuse image-wise from the photographic material into the receiving layer to form therein a visible silver image or dyestuff image, 3) separating the exposed photographic material from the receiving material, 4) pressing said receiving material containing said visible image partly or wholly into contact with a receptor material characterized in that the sticking power of said image-receiving layer can be enhanced by pressure and optionally also with heat and/or (a) solvent(s) and that the degree of the applied pressure in the presence or absence of heat effecting an increase of temperature of the receiving layer above room temperature (18°–25° C) and/or in the presence or absence of said solvent(s) is sufficient to make the pressure treated part(s) of the image-receiving material to remain on the receptor material on separating the image-receiving material from the receptor material.

In the above process silver image decalcomanias are produced when in said liquid a silver halide solvent, e.g. silver ion-complexing agent, is used that makes that undeveloped silver halide in complexed form diffuses from the photographic material into the receiving layer when the reduction to silver takes place.

The production of dyestuff decalcomanias through image-wise diffusion transfer of dyestuffs, dyestuff precursors or colour-forming couplers from a developed photo-sensitive silver halide material into a receiving-material has been described already in many articles and patents.

The present invention includes any process wherein a dyestuff image is formed by diffusion transfer of substances from a photographic material into a receiving layer and the dyestuff image or dyestuff image indicia are transferred together with at least a part of the image-receiving layer to a receptor material.

Recording processes and materials suited for forming dyestuff images through image-wise diffusion transfer of dyestuffs, dyestuff precursors or colour couplers are described, e.g., in the U.S. Pat. Nos. 2,559,643 of Edwin H. Land issued July 10, 1951, 2,698,798 of Edwin H. Land issued Jan. 4, 1955, 2,756,142 of Henry C. Yutzy issued July 24, 1956, 2,882,151 of Henry C. Yutzy and Leonard W. Tregillus issued April 14, 1959, 2,968,554 of Edwin H. Land issued Jan. 17, 1961, 2,983,606 of Howard G. Rogers issued May 9, 1961, 3,301,772 of Felix Viro issued Jan. 31, 1967, 3,628,952 of Walter Puschel, Justus Dannhauser, Paul Marx, Karl-Wilhelm Scranz, Hans Vetter and Willibald Pelz issued Dec. 21, 1971, and 3,839,035 of Wilhelmus Janssens and Raymond Gerard Lemahieu issued Oct. 1, 1974, the United Kingdom Patents 860,234 filed Feb. 4, 1958 by International Polaroid Corporation, 1,157,501 filed Sept. 10, 1965 by Ilford Limited, 1,157,503 filed Sept. 10, 1965 by Ilford Limited, 1,157,504 filed Sept. 10, 1965 by Ilford Limited, 1,157,505 filed Sept. 10, 1965 by Ilford Limited, 1,157,506 filed Sept. 10, 1965 by Ilford Limited, 1,157,508 filed Oct. 18, 1965 by Ilford Limited, 1,157,510 filed Oct. 18, 1965 by Ilford Limited, and 1,157,959 filed Oct. 19, 1965 by Ilford Limited, the German Patent 2,228,665 filed June 13, 1972 by Agfa-Gevaert A. G., and the German Patent Application 2,406,664 filed Feb. 12, 1974 by Agfa-Gevaert A. G.

In the photographic dye-diffusion transfer process of the latter German Patent Application use is made of compounds capable of releasing a dye and which are non-diffusing in photographic binder layers and which during development when oxidized in accordance with the pattern of developed silver halide are split owing to the alkali of the developer composition to release diffusing dyes, which are transferred to an image-receiving layer. The compounds capable of releasing a dye have the formula:

$$Y-NH-Ar-NH-SO_2-X$$

wherein:

Ar — represents an arylene radical such that the group Y—NH— is attached to the group —NH—$SO_2$—X through a chain of $n$ ($n$ = 1, 2, 3, or 4) vinylene groups, which are part of the arylene radical, X — represents the radical of a dye or dye precursor, Y — represents a —COR or —$SO_2$R radical, and R — represents an alkyl, aryl or heterocyclic group and can constitute part of a second dye moiety.

The above processes for forming transfer images in colour operate according to the present invention with an image-receiving material containing an image-receiving layer incorporating (an) adhesive substance(s) whose sticking power is activated with pressure and optionally also with heat and/or a solvent or solvent mixture.

The material suited for the production of decalcomanias according to the present invention contains on a support a water-permeable layer capable of serving as an image-receiving layer in a silver complex-, dye-, dye precursor- or colour coupler-diffusion transfer process characterized in that said layer is capable of obtaining by the application of pressure, optionally in the presence of heat and/or (a) solvent(s), an increase in stickiness or tackiness to such a degree that by applying at 20° C a pressure in the range of 3.5 to 70 kg per sq.cm to said layer being in contact with glassine paper that has been conditioned at a relative humidity of 60% as receptor material, the adhesion forces between the receiving layer and the receptor material become larger than the cohesion forces in the receiving layer composition so that on separating the image-receiving material from the receptor material at least a stratum of the receiving layer remains on the receptor material.

It is self-explanatory that the pressure for obtaining transfer images can be lower when the tackiness of the image-receiving layer increases by heat and/or (a) solvent(s).

The commercially available image-receiving materials have an image-receiving layer that strongly adheres to its support and therefore are not suited for the purpose of the present invention.

In the book "Testing of Adhesives" (A project of the Adhesives Testing Committee) by William H. Neuss — Tappi Monograph Series No. 26 (1963) p. 139 and 145 the term "pressure-sensitive adhesion" is defined as the adhesion of a deformable solid to a surface, effected by the application of moderate pressure.

"Tack" is defined as the ability of a material to adhere instantaneously to a solid surface when brought into contact under very light pressure. Tack in pressure-sensitive adhesives is considered to be essentially a surface phenomenon.

"Adhesion or adhesive strength" is the strength of the bond that exists at the adhesive-adherend interface.

"Cohesion" or the internal strength of the adhesive mass results from the combined action of the various molecular forces existing in the adhesive mass. Cohesion may be considered to be the resistance to separation within the adhesive mass.

On the one hand it is important that the adhesion of the image-receiving layer to its support, which is preferably a flexible backing e.g. a paper or plastic film being either or not coated with one or more subbing layers, is strong enough to allow manipulation and the diffusion transfer operation without removal of the image-receiving layer e.g. by peeling from its support by separating it from the photographic material after the image-forming diffusion transfer has taken place.

On the other hand it is necessary that the adhesion of the image-receiving layer to the receptor material after applying a certain pressure either or not in the presence of heat and/or (a) solvent(s) is high enough to ensure the rupture of cohesion bonds of the mass of the image-receiving layer so that at least a part of the image-receiving layer is transferred to the receptor material.

According to a preferred embodiment of the present invention the image-receiving layer contains a pressure-sensitive adhesive and a heat activation or solvent treatment is not required to effect the adhesive bond with the receptor material. Therefore, the adhesive must wet the surface of the adherend (the receptor material) and deform at the interface by application of pressure to achieve the bond.

It is clear from the preceding that the wettability of the receptor material by the pressure-sensitive adhesive is important in obtaining an adhesive bond. Since, however, e.g. in lay-out and drawing work transfer images are made primarily on paper, the adherence on paper as receptor material is the main point in determining a widely practical application of decalcomanias.

Therefore, when the adhesiveness of the image-receiving layer is only activated by pressure at room temperature (18°–25° C) the composition of the pressure-sensitive image-receiving layer is preferably such that the transfer of an image-containing stratum of the image-receiving layer to glassine paper (conditioned at 60% relative humidity) as receptor material is only possible after the application of a presssure at least 3 times as high as the pressure applied on contacting the light-sensitive material and the image-receiving material during the diffusion transfer operation. The pressure applied in the diffusion transfer between a pair of rollers normally does not exceed 1.5 kg per cm.

Presure-sensitive image-receiving materials for use according to the present invention contain in admixture with (an) hydrophilic colloid(s) a pressure-sensitive adhesive that inherently or through the presence of additives e.g. plasticizers obtains an increase in tackiness by application of pressure.

Pressure-sensitive adhesives are usually composed of (a) thermoplastic polymer(s) having some elasticity and tackiness, which is controlled (modified) with a plasticizer and/or a tackifying resin.

A thermoplastic polymer is completely plastic if there is no recovery on removal of stress and completely elastic if recovery is instantaneous and complete.

Preferred pressure-sensitive image-receiving materials according to the present invention contain in admixture with (a) hydrophilic colloid(s) (a) thermoplastic polymeric substance(s) and (a) plasticizer(s) and/or tackifying resins controlling the tackiness of the image-receiving layer. The thermoplastic polymer(s) is (are) preferably applied in latex form.

Polymers that are used as basis for the formulation of adhesives are described, e.g., in the above mentioned book "Testing of Adhesivves" by William H. Neuss on page 84. These polymers are:

natural rubber
butadiene-styrene rubber
chlorinated rubber
butyl rubber
neoprene rubber
butadiene-acrylonitrile rubber
polysulfides (liquids and solids)
fluoride-containing rubber
silicone rubbers
acrylic resins
alkyd resins
coumarone-indene resins
epoxy resins
petroleum polymer resins
isobutylene resins
polyurethane resins
ketone (condensed) resins
phenol-formaldehyde resins
polyamide resins
polyester resins
resorcinol resins
shellac
polystyrene resins
polyvinyl acetate resins
polyvinyl acetate copolymer resins
vinyl alkyl ether resins
cellulose acetate
cellulose nitrate
ethyl cellulose.

Particularly suitable thermoplastic polymers for the production of adhesives are, e.g., polymers and copolymers of styrene and its homologues, substituted polystyrene polymers, e.g. copolymers of styrene and butadiene and copolymers thereof with acrylonitrile, polystyrene-butadiene-acrylonitrile copolymers, acrylic and methacrylic acid ester polymers and copolymers, e.g. polybutyl acrylate and polymethyl methacrylate and copolymers of said esters with monomers, e.g. butadiene and acrylonitrile, vinyl polymers or monomers of the group of vinyl halide, vinyl alkyl esters e.g. methyl, ethyl and butyl ethers, vinyl esters e.g. vinylacetate, vinylacetals and vinyl alcohol and copolymers thereof e.g. with acrylic acid, acrylamides and itaconic acid, vinylidene halide and copolymers thereof, cellulose esters and ethers, polycarbonates, natural unvulcanised rubber, vulcanised rubber, rubber hydrochloride, synthetic rubber as polyisobutylene, polychloroprene, polybutadiene and copolymers of the monomers building these polymers, polyolefins such as polyethylene of normal and high density and polypropylene, polyesters and polyamides preferably in admixture with a hydrophilic colloid for forming a water-permeable layer.

Pressure-sensitive adhesives are described more particularly e.g. in the Canadian Patent 728,607 filed Mar. 7, 1963 by Letraset Limited and the U.S. Pat. No. 3,131,106 of Frederick Wilson Mackenzie issued Apr. 18, 1964. They consist of a tacky resin or polymer.

An intrinsically non-tacky polymer may be tackified by the addition of a tackifying substance, e.g. a plasticizer or tackifying resin.

Useful plasticizers are, e.g., dimethylphthalate, diethyl phthalate, dipropylene glycol dibenzoate, dibutoxyethyl phthalate, triacetin, butyl benzyl phthalate, methyl phthalyl ethyl glycolate and tricresyl phosphate.

Useful tackifying resins are, e.g., rosin and rosin derivatives such as hydrogenated rosin esters and alcohols; liquid polymeric styrenes and styrene homologues; polymerised terpenes such as a pinene; ketone resins; low molecular weight polyisobutylenes and other olefins.

The modified coumarone-indene resings are excellent tackifier resins for polyvinyl acetate. sulfonamide-formaldehyde resins are used to improve the adhesion of polyvinyl acetate formulations to cellophane and other transparent cellulosic films.

The gasoline-insoluble fraction of rosin is a low cost, dark-brown resin that can be used to improve the specific adhesion for a wide variety of metallic and polar materials. It cannot be used in cases where the colour of the indicia to be transferred is an important factor.

A tack-controlling agent may be incorporated in the receiving layer preferably in the form of a soft or easily deformable material to allow good flow and contact with the receptor material. Particularly suitable tack-controlling agents are long chain hydrocarbons containing at least 12 carbon atoms such as paraffin and microcrystalline wax, polyethylene waxes, fatty acids and their derivatives such as metal salts, esters, alcohols, amides, nitriles and amines and particularly fatty acid mono- or polyesters of polyols and polyethylene glycols and fatty alcohol esters of polyethylene glycols, polyethylene and polypropylene glycols, or solid finely divided materials such as silica flour or solid polymer particles.

The adhesives are incorporated in the image-receiving layer composition after having been dissolved or dispersed in organic solvents or after having been emulsified in water. In orderr to improve the adherence, the non-volatile constituents of the adhesive may be reactive towarrds the support surface.

Heat-activated adhesives as described in the Canadian Patent 728,607 mentioned hereinbefore contain a polymer, that may become tacky on heating, or a tackifying resin or plasticizer is added, preferably to form a composition, which is non-tacky or even non-blocking at room temperature. The incorporation of a solid plasticizer as a fine dispersion of crystals in the polymer is valuable as a delayed tack heat-activated adhesive, whereby the plasticizer melts and tackifies the polymer at the activating temperature, but when the adhesive cools it remains tacky until the plasticizerr crystallises again. Suitable polymers are ethyl- and hydroxyethylcellulose, polyvinyl acetate and polyamides. Tackifying materials are included in the materials listed for pressure-sensitive adhesives.

Many of the above heat-activated adhesives may be used as solvent-activated adhesives. According to the French Patent 2,066,228 filed Oct. 20, 1970 by Letraset Limited use is made of microparticles, whose concentration in the adhesives used characterize the degree of viscosity.

As already mentioned the image-receiving layer has a water-permeable character and for that purpose it contains a sufficient amount of hydriophilic colloid known from the prior art diffusion transfer image-receiving materials. The preferably used hydrophilic colloid is gelatin but other hydrophilic collids, e.g. those described in the United Kingdom Patents 998,955 filed Oct. 19, 1961 by Gevaert Photo-Producten N.V. and 998,956 filed Oct. 19, 1961 by Gevaert Photo-Producten N.V., may be used too but preferably in admixture with gelatin.

The image-receiving layer for use according to the present invention may contain thickeners to increase the viscosity for proper machining and to increase adhesion to a specific surface.

Thickeners are usually water-soluble polymers of relatively high molecular weight. The preferred thickeners are those commonly used in polymer latex preparation, e.g. in acrylate and vinyl acetate polymer emulsions, and include methylcellulose, polyvinyl alcohol, polyvinyl methyl ether, polyacrylic acid salts, sodium carboxymethylcellulose, hydroxyethylcellulose, sodium alginate and modified starch and casein.

Another additive of the image-receiving layer composition is a wetting agent or mixture of wetting agents. As suitable wetting agents to ensure the proper wetting and possibly the penetration of the surface to be adhered are mentioned: dioctyl ester of sulfosuccinic acid, sodium tetradecyl sulfate, dodecyl benzene sodium sulfonates, alkylarylpolyether alcohols, sodium salt of oleylmethyl tauride and saponine. The content of the substances providing and/or controlling the adhesive character of the image-receiving layer is to be adjusted by tests in order to find a useful combination for preparing decalcomanias on a wide variety of receptor materials.

When used in the silver complex diffusion transfer process the image-receiving layer contains preferably already in the coating stage development nuclei for promoting the formation of the silver-containing image, e.g. sulphides of heavy metals, e.g. of antimony, bismuth, cadmium, cobalt, lead, nickel, silver and zinc. Selenides, polysulphides, polyselienides, mercaptans, tin(II)halides, heavy metals or their salts and fogged silver halides are also suitable for this purpose. The complex salts of lead sulphide and zinc sulphide are effective either in themselves or mixed with thioacetamide, dithiobiuret or dithio-oxamide. Among the heavy metals, silver, gold, platinum, palladium and mercury are particularly worthy of mention, especially in thier colloidal form.

In order to obtain a neutral image tint the receiving layer for use in the silver complex diffusion transfer process contains so-called oners, e.g. 1-phenyl-1H-tetrazole-5-thiol and other compounds described, e.g., in "Photographic Silver Halide Diffusion Transfer Processes" by A. Rott and E. Weyde, Focal Press, London — New York (1972) p. 229–238.

The image-receiving layers suited for use in a dye- or colour-forming diffusion transfer process may contain compounds for fixing the dyes i.e., so-called mordanting agents and optionally also oxidants either or not in admixture with a reactant forming on oxidative coupling with a transferred coupler a dyestuff e.g. as described in the U.S. Pat. No. 3,839,035 mentioned hereinbefore.

The support of the image-receiving material for use according to the present invention may be of any kind of material and may comprise individual sheets or a web material of paper, plastic or metal. When separate indicia have to be transferred the support material and the image-receiving layer are preferably light-transmitting i.e., translucent or transparent in order to enable the visual positioning of the image-receiving material serving as indicia carrier sheet on the receptor surface whereto the indicia formed should transfer.

Transparent supports are films of cellulose nitrate, cellulose esters, polyvinylacetal, polystyrene, polyethylene terephthalate and other polyester materials as well as resin-or polymer-coated paper, e.g. paper coated with polyethylene or polypropylene.

Preferred supports comprise a linear condensation polymer, a polyethylene terephthalate being an example thereof. The mechanical strength of melt-extruded supports of the polyester type can be improved by stretching.

The supports used in the present image-receiving materials may be coated with subbing layers for improving the adhesion of the image-receiving layer thereto.

Suited subbing layers for adhering hydrophilic layers to hydrophobic supports are known to those skilled in the art of silver halide photography. With regard to the use of hydrophobic film supports reference is made, e.g., to the composition of subbing layers described in the United Kingdom Patent 1,234,755 filed Sept. 28, 1967 by the Applicant.

According to said patent a hydrophobic film support has 1) a layer that is directly adherent to said hydrophobic film support and comprises a copolymer formed from 45 to 99.5% by weight of at least one of the chlorine-containing monomers vinylidene chloride and vinyl chloride, from 0.5 to 10% by weight of at least one ethylenically unsaturated hydrophilic monomer, and from 0 to 54.5% weight of at least one other copolymerisable ethylenically unsaturated monomer, and 2) a layer comprising in a ratio of 1:3 to 1:0.5 by weight a mixture of gelatin and a copolymer of 30 to 70% by weight of butadiene with at least one copolymerisable ethylenically unsaturated monomer.

The support sheet can be provided with, or contain waxy or adhesive ingredients to facilitate the transfer of the indicia upon pressure. As described in the United Kingdom Patent 906,934 mentioned hereinbefore, such wax is, e.g., FLEXOWAX C (trade mark of Glyco Chem. Inc. U.S.A.), which consists of 100 parts by weight of paraffin wax and 50 parts of a soft, very tacky grade of polyisobutylene having a molecular weight of approximately 1500.

The light-sensitive material used according to the present invention may be of any type used in the production of silver images and dyestuff images in a diffusion transfer process. In order to obtain in the silver complex diffusion transfer process a high maximum density in te indicia, preference is given to a silver chloride or a silver chlorobromide emulsion, which are used in the known silver complex diffusion transfer processes. Details can be found, e.g., in "Photographic silver halide diffusion transfer processes" by A. Rott and E. Weyde referred to above and in the references cited therein.

Photographic materials suited for producing colour images by diffusion transfer are described in detail in the above mentioned documents concerning recording processes and materials suited for forming dyestuff images through diffusion transfer of dyestuffs, dyestuff precursors or colour couplers. Preferred materials are described in the German Patent Application 2,406,664 and the U.S. Pat. No. 3,839,035 both mentioned before. According to the invention described in the latter patent monochrome or multicolour images are produced.

Basically the photographic material for the reproduction of monochrome images comprises a silver halide emulsion layer, a colour developing substance that cannot diffuse in alkaline medium, a colour coupler and a reactant for said colour coupler, which both can diffuse in alkaline medium. The image-receiving material comprises an oxidizing agent effecting the coupling of the diffused colour coupler and reactant in the alkaline aqueous liquid used in the development of the exposed silver halide and the diffusion transfer of both colour couplers and corresponding reactant.

In the production of silver images that serve in the formation of decalcomanias according to the present invention, an alkaline aqueous liquid is used in the development. Said liquid is called activating liquid when it is free from developing agent. The latter is contained in the light-sensitive silver halide material and/or in the image-receiving material.

Suitable developing agents for the exposed silver halide are, e.g., hydroquinone and 1-phenyl-3-pyrazolidinone and p-monomethylaminophenol. The development or activating liquid contains in the process for forming a silver image through the silver complex diffusion transfer process a silver halide solvent, e.g., a complexing compound such as an alkali metal or ammonium thiosulphate or thiocyanate, or ammonia. Alternatively or in addition such complexing compound may be present in the image-receiving layer.

The exposure of the light-sensitive material and the diffusion transfer proceed preferably with, or in the apparatus commercially available therefor and of which several types have been described in the already mentioned book of A. Rott and E. Weyde.

The pressure required to transfer indicia may be applied by manual means, e.g. as a series of close strokes with a pointed means, a stylus or ball point pen or by mechanical means as described in the United Kingdom Patent 1,113,695 mentioned hereinbefore.

The pointed means is used to rub the rear side of the image-receiving material while having the image-receiving layer in contact with the receptor material. When an indicia design consists of several pieces of disconnected detail, each individual piece must be subjected sufficiently to pressure.

The transfer of indicia incorporated in the image-receiving layer or a stratum thereof may proceed on any kind of receptor material, e.g. paper, metal, wood, glass, or resin film. According to a special embodiment a stratum of the image-receiving layer in conformity with an indicium or with indicia is transferred to a screen as receptor. Such screen can be used in screen printing. Ink applied to one side of the image-wise blocked screen passes through the free screen openings so that on a receptor material of any nature in contact with the other side an ink-image is obtained.

Details of that kind of process have been described in the French Patent 2,167,012 filed Dec. 12, 1972 by Letraset International Limited.

The following example illustrates the present invention.

EXAMPLE

A photographic silver halide material suited for use in the silver complex diffusion transfer process was prepared in such a way that its gelatin-silver halide emulsion layer contained an amount of silverchlorobromide corresponding with 2.5 g of silver nitrate per sq.m. In the emulsion layer hydroquinone and 1-phenyl-4-methyl-3-pyrazolidone were incorporated in an amount of 1 and 0.25 g per sq.m respectively.

The silver halide emulsion layer was coated at one side of a subbed water-resistant paper support consisting of a paper base having a weight of 110 g/sq.m and coated at both sides with a polyethylene stratum in a ratio of 15 g/sq.m per side.

A non-light-sensitive image-receiving material was prepared by coating onto a subbed polyethylene terephthalate support the following composition at a coverage of 50 g per sq.m.:

water
ethanol — 50 ml
carboxymethylcellulose -- 13 g
gelatin — 10 g
nickel sulphide nuclei (an aqueous suspension of 2% by weight of gelatin and 0.6% by weight of NiS) — 7.5 ml
11.7% aqueous solution (consisting of 74.8 parts of water and 18.7 parts of ethanol) of SAPONIN S (registered trade mark marketed by Schmidtmann) — 70 ml
12.7% aqueous solution of HOSTAPON T (registered trade mark for oleylmethyl tauride marketed by Hoechst AG, Frankfurt/M., W. Germany) — 20 ml
40% aqueous latex of a copoly(methylmethacrylate/-butyl acrylate) (20:80) vol% — 500 ml
dimethyl phthalate — 150 ml
starch — 200 ml
water — 200 ml.

Before the application of said image-receiving layer composition the polyethylene terephthalate support, which was a biaxially oriented polyethylene terephthalate film of 180$\mu$m thickness, was coated at 25° C in a proportion of 2 g/sq.m with a first subbing layer composition of: copoly(vinyl chloride/n-butyl acrylate/methacrylic acid) (70:26:4) — 8 g
methylene chloride — 20 ml
dichloroethane — 20 ml.

After drying a second subbing layer was applied thereto at 25° C in a proportion of 0.6 g/sq.m from the following coating composition:

20% latex of copoly(butadiene/ethyl acryklate) (50:50) — 6.25 g
gelatin — 1 g
water — 60 ml
methanol — 40 ml.

The light-sensitive material was exposed to a line original in a reflex camera. The emulsion side was brought in contact with the image-receiving side of the image-receiving element. While in contact, the materials were run through a common silver complex diffusion transfer apparatus containing a liquid having the following composition:

water — 800 ml
tribasic sodium phosphate-12-water — 75 g anhydrous sodium sulphite — 40 g
potassium bromide — 0.5 g
anhydrous sodium thiosulphate — 20 g
1-phenyl-5-mercaptotetrazole — 70 mg
water to make — 1000 ml.

When the sandwich of light-sensitive material and image-receiving material left the squeezing rollers of the silver complex diffusion transfer apparatus, the materials were still kept in contact for 60 s and then separated from each other.

The image-receiving material was brought into contact at 20° C with a glassine paper receptor surface, conditioned at 60% relative humidity whereupon sufficient pressure was applied to the reverse side of the image-receiving material to transfer a stratum of the image-receiving layer together with the silver image indicia formed therein.

The pressure applied to said transfer was about 50 kg/sq.cm.

By replacing the above mentioned copoly(methylmethacrylate/butyl acrylate) by a same amount of one of a polymer formed with monomer(s) mentioned in the following table, analogous results were obtained. The percentages are by weight.

Table (1)

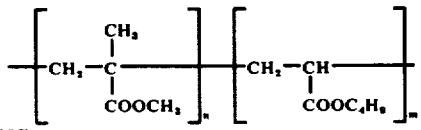

n = 20%
m = 80%

(2)

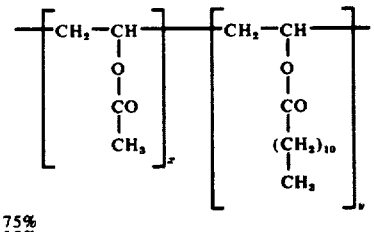

x = 75%
y = 25%

(3)

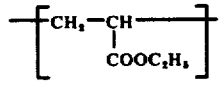

(4)

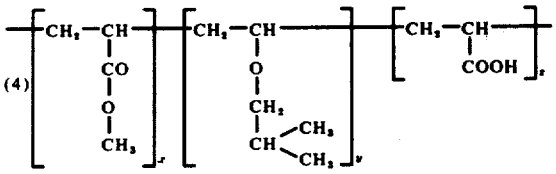

x = 50%
y = 48%
z = 2%

(5)

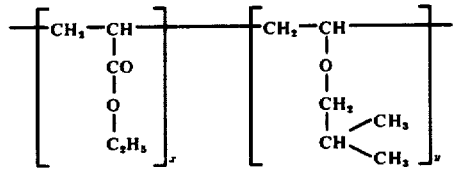

x = 78%
y = 22%

(6)

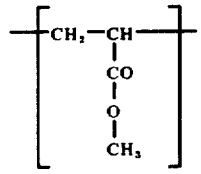

Table-continued (7)

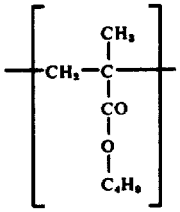

(8)

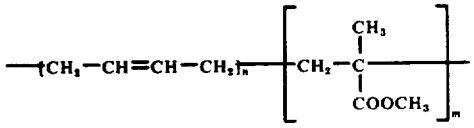

n = 50
m = 50

(9)

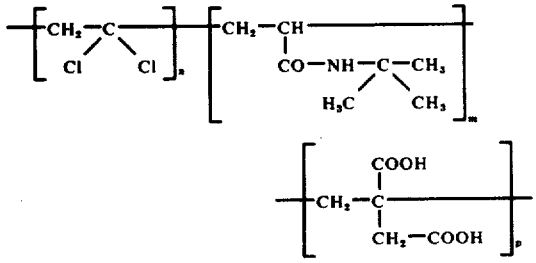

n = 88
m = 10
p = 2

(10)

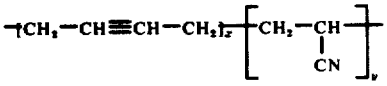

x = 65.9%
y = 34.1%

(11)

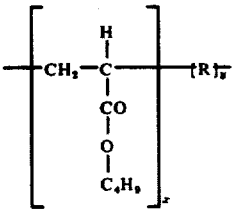

x > y
R = —H or —$CH_3$

We claim:

1. A process for the production of transfer images comprising the steps of:

1. photographically exposing a photographic material carrying a light-sensitive silver halide emulsion layer;
2. contacting the emulsion layer side of the exposed photographic material with a supported image-receiving layer of an image-receiving material, said image-receiving layer containing developing or precipitating nuclei, in the presence of a developing liquid for the exposed silver halide and a silver halide solvent to diffuse developed silver halide image-wise from the photographic material into the receiving layer to form therein a visible silver image;

3. separating the exposed and developed photographic material from the receiving layer carrying said visible silver image;
4. pressing said receiving layer carrying said visible image at least partly into contact with a receptor material, said image-receiving layer comprising a mixture of a hydrophilic colloid, a thermoplastic latex, and at least one of a plasticizer or a tackifying resin, and being adapted to undergo an increase in sticking power upon the application of pressure and optionally with heat and/or solvents sufficient to make the pressure-receiving regions of said image-receiving layer remain adhered on the receptor material upon separation of the image-receiving material from the receptor material; and
5. separating said image-receiving material from the receptor material to leave at least a portion of the pressure-receiving regions of said image-receiving layer upon said receptor material.

2. A process according to claim 1 wherein said pressure is applied at room temperature and with a magnitude at least 3 times as high as the pressure applied in the contacting step between the exposed photographic material and the image-receiving material.

3. A process according to claim 2, wherein the image-receiving layer is a water-permeable layer.

4. A process according to claim 3, wherein said thermoplastic polymer is of the group consisting of: polymers of styrene and its homologues, acrylic acid esters, methacrylic acid esters, vinyl halides, vinyl ethers, vinyl esters, vinyl acetals and vinyl alcohol, cellulose esters and ethers, polycarbonates, natural unvulcanised rubber, vulcanised rubber, rubber hydrochloride, polyisobutylene, polychloroprene, and polybutadiene.

5. A process according to claim 1, wherein said plasticizer is dimethyl phthalate, diethyl phthalate, dipropylene glycol dibenzoate, dibutoxyethyl phthalate, triacetin, butylbenzyl phthalate, methyl phthalyl ethyl glycolate or tricresyl phosphate.

6. A process according to claim 4, wherein the image-receiving layer contains as said tackifying resin rosin or a rosin derivative, a liquid polymeric styrene or homologue, polymerized pinene, ketone resin, or low molecular weight polyisobutylene.

7. A process according to claim 4, wherein the image-receiving layer contains as an additional tack-controlling agent a long-chain hydrocarbon of at least 12 carbon atoms, a fatty acid or a derivative thereof, a polyethylene glycol, a polypropylene glycol or a fatty alcohol ester of a polyethylene glycol.

8. A process according to claim 1, wherein the image-receiving layer contains gelatin.

9. A process according to claim 1, wherein the image-receiving layer contains a wetting agent.

10. A process according to claim 1, wherein the image-receiving layer contains a toner to obtain a silver image with neutral tint.

11. A process according to claim 1, wherein the support of the image-receiving material is translucent or transparent.

12. A process according to claim 1, wherein the emulsion layer of the photographic material contains silver chloride or silver chlorobromide.

13. A process according to claim 1, wherein the liquid is an alkaline aqueous liquid containing an alkali metal or ammonium thiosulphate, and a developing agent for exposed silver halide is contained in said liquid or introduced therein from the photographic material and/or image-receiving material during contacting.

14. A process according to claim 1, wherein the pressing is effected by rubbing a pointed member in close strokes against the rear-side of the image-receiving material while having the image-receiving layer in contact with the receptor material.

15. A process for the production of transfer images comprising the steps of:

1. photographically exposing a photographic material containing a light-sensitive silver halide emulsion layer and a releasable dye-image-forming substance;
2. contacting the emulsion layer side of the exposed photographic material with a supported image-receiving layer of an image-receiving material, in the presence of a liquid for developing the exposed silver halide and releasing said dye-image-forming substance image-wise from the photographic material for diffusion into the receiving layer to form therein a visible dyestuff image;
3. separating the exposed and developed photographic material from the receiving material carrying the visible dyestuff image;
4. pressing said receiving material containing said visible dyestuff image at least partly into contact with a receptor material, said image-receiving layer comprising a mixture of a hydrophilic colloid, a thermoplastic polymer, latex and at least one of a plasticizer or a tackifying resin, and being adapted to undergo an increase in sticking power upon the application of presssure and optionally with heat and/or solvents sufficient to make the pressure-receiving regions of said image-receiving layer to remain adhered on the receptor material upon separation of the image-receiving material from the receptor material; and
5. separating said image-receiving material from the receptor material to leave at least a portion of the pressure-receiving regions of said image-receiving layer upon said receptor material.

16. A process according to claim 15, wherein said pressure is applied at room temperature and with a magnitude at least 3 times as high as the pressure applied in the contacting step between the exposed photographic material and the image-receiving material.

17. A process according to claim 16, wherein the image-receiving layer is a water-permeable layer.

18. A process according to claim 15, wherein said thermosplastic polymer is of the group consisting of polymers of styrene and its homologues, acrylic acid esters, methacrylic acid esters, vinyl halides, vinyl ethers, vinyl esters, vinyl acetals and vinyl alcohol, cellulose esters and ethers, polycarbonates, natural unvulcanised rubber, vulcanised rubber, rubber hydrochloride, polyisobutylene, polychloroprene, and polybutadiene.

19. A process according to claim 15, wherein said plasticizer is dimethyl phthalate, diethyl phthalate, dipropylene glycol dibenzoate, dibutoxyethyl phthalate, triacetin, butylbenzyl phthalate, methyl phthalyl ethyl glycolate or tricresyl phosphate.

20. A process according to claim 18, wherein the image-receiving layer contains as said tackifying resin rosin or a rosin derivative, a liquid polymeric styrene or homologue, polymerized pinene, ketone resin, or low molecular weight polyisobutylene.

21. A process according to claim 18, wherein the image-receiving layer contains as an additional tack-controlling agent a long-chain hydrocarbon of at least 12 carbon atoms, a fatty acid or a derivative thereof, a polyethylene glycol, a polypropylene glycol or a fatty alcohol ester of a polyethylene glycol.

22. A process according to claim 15, wherein the image-receiving layer contains gelatin.

23. A process according to claim 15, wherein the pressing is effected by rubbing a pointed member in close strokes against the rear-side of the image-receiving material while having the image-receiving layer in contact with the receptor material.

* * * * *